US011078743B2

(12) United States Patent
Mani et al.

(10) Patent No.: US 11,078,743 B2
(45) Date of Patent: Aug. 3, 2021

(54) SYSTEM AND METHODOLOGY FOR PROVIDING BYPASS THROUGH A SWELLABLE PACKER

(71) Applicant: Schlumberger Technology Corporation, Sugar Land, TX (US)

(72) Inventors: Saikumar Mani, Pearland, TX (US); Nabil Batita, Gabes (TN); Nikhil Nair, Cupertino, CA (US); Joao Mendonca, Rosharon, TX (US); Oloruntoba Ogunsanwo, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 161 days.

(21) Appl. No.: 16/414,514

(22) Filed: May 16, 2019

(65) Prior Publication Data

US 2020/0362660 A1 Nov. 19, 2020

(51) Int. Cl.
*E21B 33/12* (2006.01)
*E21B 17/18* (2006.01)

(52) U.S. Cl.
CPC ..... *E21B 33/12* (2013.01); *E21B 17/18* (2013.01); *E21B 33/1208* (2013.01)

(58) Field of Classification Search
CPC ..... E21B 33/12
See application file for complete search history.

(56) References Cited

U.S. PATENT DOCUMENTS

| | | | | |
|---|---|---|---|---|
| 5,875,852 | A * | 3/1999 | Floyd | E21B 17/003 166/191 |
| 6,325,144 | B1 * | 12/2001 | Turley | E21B 17/025 166/120 |
| 6,481,496 | B1 * | 11/2002 | Jackson | E21B 33/128 166/120 |
| 7,836,960 | B2 | 11/2010 | Patel et al. | |
| 8,082,990 | B2 | 12/2011 | Lovell et al. | |
| 8,235,108 | B2 | 8/2012 | Lemme et al. | |
| 8,322,415 | B2 | 12/2012 | Loretz et al. | |
| 8,794,310 | B2 | 8/2014 | Allen et al. | |
| 9,243,473 | B2 | 1/2016 | Yang et al. | |
| 2002/0074116 | A1 * | 6/2002 | Millar | E21B 33/1295 166/120 |
| 2003/0079878 | A1 * | 5/2003 | Pramann, II | E21B 43/14 166/278 |
| 2005/0257928 | A1 * | 11/2005 | Arizmendi | E21B 33/12 166/120 |
| 2011/0056706 | A1 | 3/2011 | Brooks | |

(Continued)

*Primary Examiner* — Robert E Fuller
(74) *Attorney, Agent, or Firm* — Fletcher Yoder P.C.

(57) ABSTRACT

A swellable packer comprises an elastomeric element and a mandrel extending through the elastomeric element. The elastomeric element is formed of an elastomer which undergoes swelling following contact with certain types of well fluids. The elastomeric element is sealed with respect to the mandrel and may be located along an undercut region of the mandrel. Additionally, the mandrel has an interior passage extending longitudinally through the mandrel and offset with respect to an external geometry of the mandrel. Accordingly, the mandrel is effectively constructed with relatively thicker and thinner wall sections. The thicker wall section or sections accommodates at least one bypass conduit which extends longitudinally through the mandrel.

20 Claims, 3 Drawing Sheets

(56) References Cited

U.S. PATENT DOCUMENTS

2015/0354315 A1* 12/2015 Windegaard ..... E21B 43/123
166/374
2017/0037710 A1* 2/2017 Richards ..... E21B 33/12

* cited by examiner

SYSTEM AND METHODOLOGY FOR PROVIDING BYPASS THROUGH A SWELLABLE PACKER

BACKGROUND

In many well applications, a well string is deployed downhole into a wellbore. For some downhole applications, swellable packers may be deployed along the well string to enable isolation of a section or sections of the wellbore. Swellable packers utilize an elastomeric packer element disposed about a base pipe. The elastomeric packer element may be formed with a polymer which swells in the presence of well fluids to form a seal with the surrounding wellbore surface. Swellable packers may be used in various well applications ranging from well construction to well completion in both open hole and cased hole wells.

Depending on the type of equipment employed in the well string, control lines may be run downhole. To bypass a swellable packer, slits are formed in the elastomeric packer element and the control lines are inserted through the slits. As the elastomeric packer element swells it closes the slit around each control line to form a seal with the control line. However, the presence of these bypass slits substantially reduces the pressure holding capacity of the swellable packer.

SUMMARY

In general, a system and methodology are provided to facilitate sealing along a well string. According to an embodiment, a swellable packer comprises an elastomeric element and a mandrel extending through the elastomeric element. The elastomeric element is formed of an elastomer which undergoes swelling following contact with certain types of well fluids. The elastomeric element is sealed with respect to the mandrel and may be located along an undercut region of the mandrel. Additionally, the mandrel has an interior passage extending longitudinally through the mandrel and offset with respect to an external geometry of the mandrel. Accordingly, the mandrel is effectively constructed with relatively thicker and thinner wall sections. The thicker wall section or sections accommodates a plurality of bypass conduits which extend longitudinally through the mandrel.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate sealing along a borehole while accommodating one or more control lines or other structures such as shunt tubes. According to an embodiment, a swellable packer comprises a swellable elastomeric element and a mandrel, e.g. a base pipe, extending through the elastomeric element. The swellable packer may be positioned along a well string to facilitate sealing between the well string and a surrounding borehole wall, e.g. a cased or open hole wellbore wall.

The elastomeric element is formed of an elastomer which undergoes swelling following contact with certain types of well fluids, e.g. hydrocarbon-based fluids. Additionally, the elastomeric element is sealed with respect to the mandrel and may be located along an undercut region of the mandrel. For example, the elastomeric element may be adhered to the mandrel or otherwise sealed to the mandrel. The undercut region may extend along an exterior of the mandrel for a substantial length of the elastomeric element, e.g. at least half the length of the elastomeric element. The undercut enables increased volume of the elastomer and increased radial distance between the exterior of the mandrel and the exterior of the elastomeric element. In some embodiments, the undercut region extends to the longitudinal ends of the elastomeric element.

Additionally, the mandrel has an interior passage extending longitudinally through the mandrel and offset with respect to an external geometry of the mandrel. Accordingly, the mandrel is effectively constructed with relatively thicker and thinner wall sections. The thicker wall section or sections accommodates at least one bypass conduit. In various embodiments, the thicker wall section or sections accommodates a plurality of bypass conduits which extend longitudinally through the mandrel. The mandrel may be formed of a metal material such that the bypass conduits extend through the metal material of the mandrel internally of the elastomeric element. The number of bypass conduits which may be located within the mandrel wall may be governed by the eccentricity and size of the internal geometry of the mandrel along with the geometry, radial spacing, and angular spacing of the bypass conduits.

Figure 1:
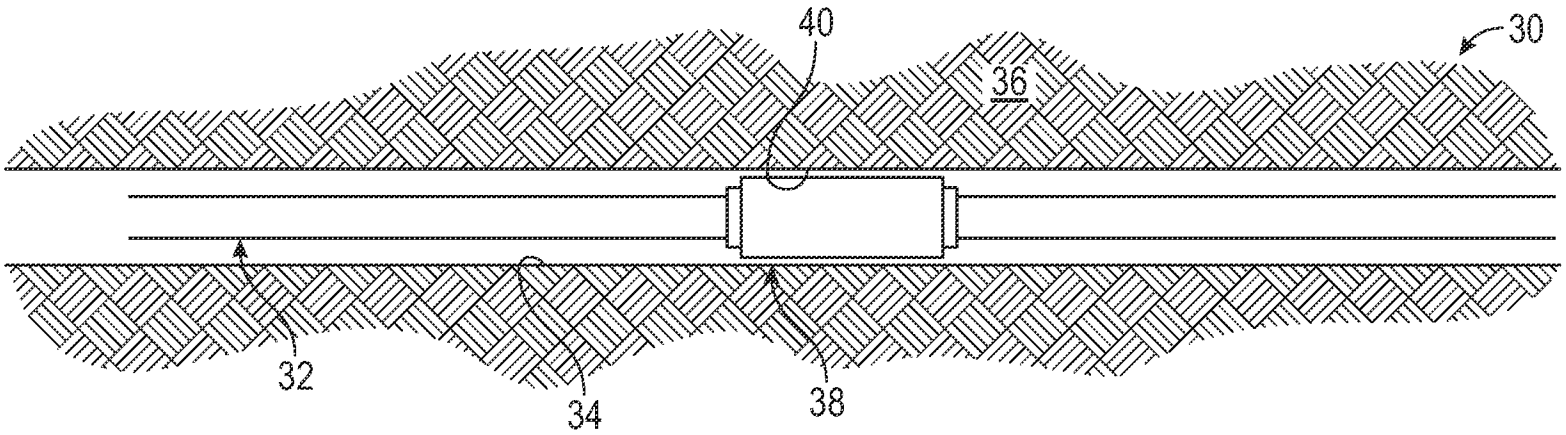
FIG. 1 is an illustration of a well string deployed in a borehole, the well string comprising at least one swellable packer, according to an embodiment of the disclosure.

Referring generally to FIG. 1, an example of a well system 30 is illustrated. The well system 30 may comprise a well string 32, e.g. a well completion string, deployed in a wellbore 34 or other type of borehole. The wellbore 34 may be a vertical wellbore, a deviated wellbore, e.g. horizontal wellbore, or other suitably oriented wellbore formed in a geologic formation 36. By way of example, the geologic formation 36 may comprise hydrocarbon fluids such as oil and natural gas.

The illustrated well system 30 also comprises a swellable packer 38 which may be transitioned between a radially contracted position and a radially expanded position following sufficient exposure to specific types of well fluids, e.g. hydrocarbon-based fluids. In FIG. 1, the swellable packer 38 is illustrated in the radially expanded position in sealing engagement with a surrounding borehole wall 40. The well string 32 may comprise various numbers of swellable packers 38 and various other types of equipment, e.g. completion equipment.

Figure 2:
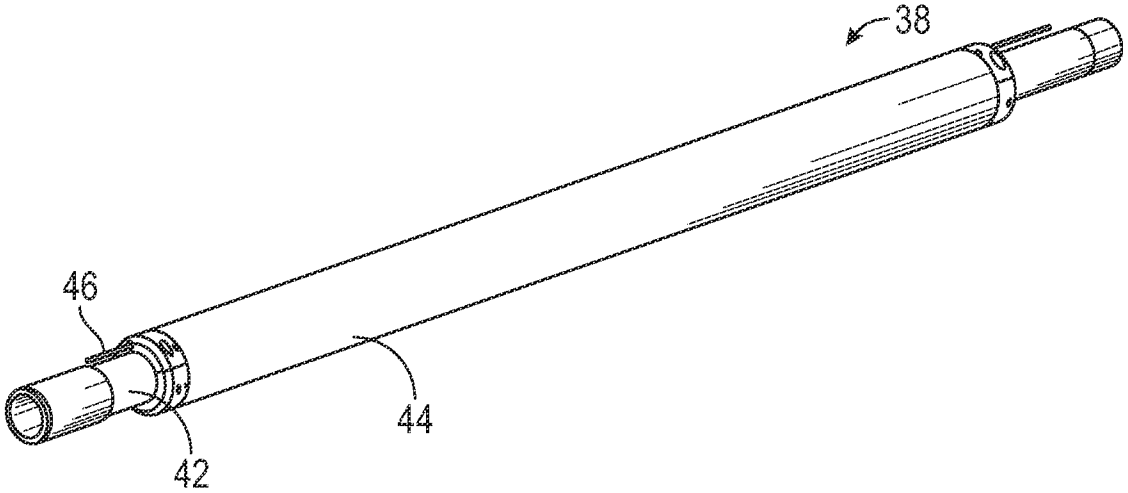
FIG. 2 is an orthogonal view of an example of a swellable packer, according to an embodiment of the disclosure.

Referring generally to FIG. 2, an example of swellable packer 38 is illustrated. In this embodiment, the swellable packer 38 comprises a mandrel 42 and an elastomeric element 44. The mandrel 42 extends through the elastomeric element 44 which is sealed, e.g. adhered or otherwise bonded, to the mandrel 42. The elastomeric element 44 is formed from a material, e.g. a complex polymer, which swells in the presence of certain types of fluid, e.g. well fluids, as with traditional swellable packers. At least one communication line 46 is routed longitudinally through the material forming the mandrel 42 as explained in greater detail below. By way of example, the communication line or lines 46 may comprise electrical lines, hydraulic control lines, shunt tubes, and/or other types of communication lines for communicating signals and/or fluid through the swellable packer 38.

Figure 3:
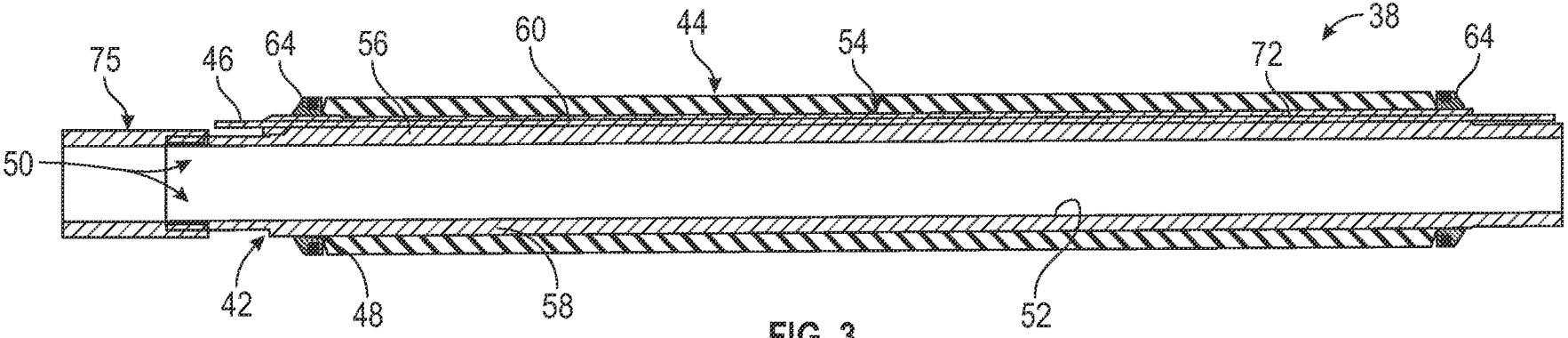
FIG. 3 is a cross-sectional view of an example of a swellable packer taken generally along a longitudinal axis of the swellable packer, according to an embodiment of the disclosure.

With additional reference to FIG. 3, a cross-sectional illustration of the swellable packer 38 is provided. As illustrated, the mandrel 42 has a mandrel wall 48 which forms an internal geometry 50 in the form of a longitudinal passage 52 extending longitudinally through the mandrel 42. By way of example, the internal geometry 50 and longitudinal passage 52 may have a circular cross-section which maintains a consistent diameter through the mandrel 42. In some embodiments, however, the internal geometry 50 and longitudinal passage 52 may have varying diameters and/or non-circular cross-sections. The mandrel 42 also provides an external geometry 54 having a cross-sectional center offset from a cross-sectional center of the internal geometry 50.

The internal geometry 50/longitudinal passage 52 effectively becomes eccentrically located with respect to the external geometry 54. The eccentricity of the mandrel 42 establishes a thicker wall portion 56 of mandrel wall 48 relative to a thinner wall portion 58, as further illustrated in FIG. 4. The thicker wall portion 56 provides room for a bypass conduit 60, e.g. a plurality of bypass conduits 60, formed within the mandrel wall 48 radially inward of elastomeric element 44. In other words, the bypass conduits 60 may be contained within the material, e.g. metal material, of which mandrel 42 is formed.

The bypass conduit or conduits 60 may be constructed to accommodate various types of communication lines 46. For example, individual bypass conduits 60 may be constructed to enable passage therethrough of an electrical control line or hydraulic control line. In some embodiments, individual bypass conduits 60 may be constructed to provide a portion of the communication line 46 itself. For example, a section of hydraulic line or shunt tube can be coupled to each end of a given bypass conduit 60 and the bypass conduit 60 can simply route fluid through the mandrel 42 of swellable packer 38.

Depending on the parameters of a given application, various types of fittings 62, e.g. connectors, may be used at the ends of each bypass conduit 60 to form a seal between the material of mandrel 42 and the corresponding communication line 46. In some embodiments, the fittings 62 may be in the form of wet connects or other types of connectors into which sections of communication line 46 may be coupled. The number and arrangement of bypass conduits 60 and corresponding communication lines 46 may vary according to the parameters of an intended operation. By way of example, the mandrel 42 and thicker wall portion (or portions) 56 may be constructed to accommodate 2 bypass conduits, 3 bypass conduits, 4 bypass conduits, or 5 or more bypass conduits 60.

Figure 5:
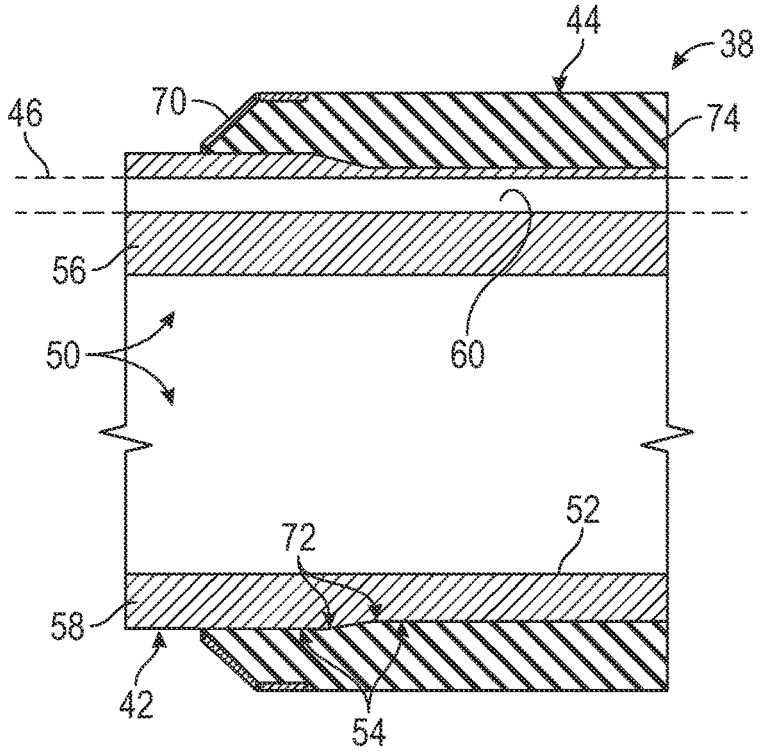
FIG. 5 is another cross-sectional illustration showing a portion of an example of a swellable packer, according to an embodiment of the disclosure.

In some embodiments, end caps 64 may be secured to the exterior of mandrel 42 at longitudinal ends of elastomeric element 44 to protect and/or limit axial expansion of the elastomeric element 44 during swelling. The end caps 64 may be secured to the mandrel 42 by an attachment mechanism 66 which may be in the form of setscrews 68. According to some embodiments, a protective shielding 70 also may be positioned at the longitudinal ends of elastomeric element 44. The protective shielding 70 may be used with end caps 64 or without end caps 64, as illustrated in FIG. 5.

Referring again to FIGS. 4 and 5, the mandrel 42 also may comprise an undercut 72 formed along the exterior of mandrel 42. The undercut 72 provides a region of reduced outside diameter along a portion of the mandrel 42 so as to enable construction of elastomeric element 44 with a greater thickness and a greater volume of a swellable material 74. The undercut 72 may be a region which extends along an exterior of the mandrel 42 for a substantial length of the elastomeric element 44. Additionally, the undercut 72 may extend around the entire circumference of the mandrel 42, although some embodiments may employ an undercut 72 which extends along a portion of the circumference.

Figure 4:
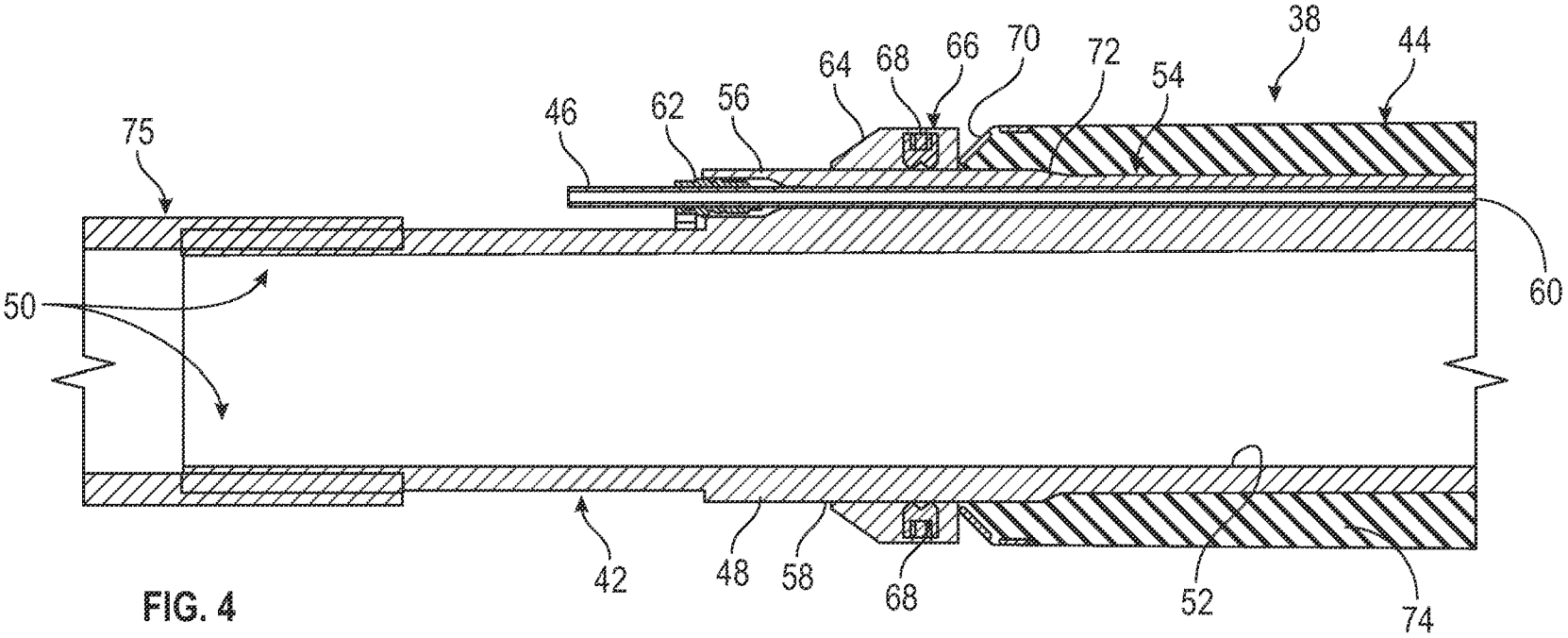
FIG. 4 is a cross-sectional view showing a portion of the swellable packer illustrated in FIG. 3, according to an embodiment of the disclosure.

Depending on various factors such as swellable packer size and pressure rating, the undercut 72 may extend at least 50% of the length of the elastomeric element 44, at least 75% of the length of elastomeric element 44, or at least 90% of the length of elastomeric element 44. In some embodiments, the undercut 72 provides a region of decreased mandrel diameter which extends to the longitudinal ends of the elastomeric element 44, as illustrated in FIGS. 4 and 5. It should be noted various types of couplers 75, e.g. threaded ends or separate threaded couplers, may be used to connect swellable packer 38 into well string 32.

Figure 6:
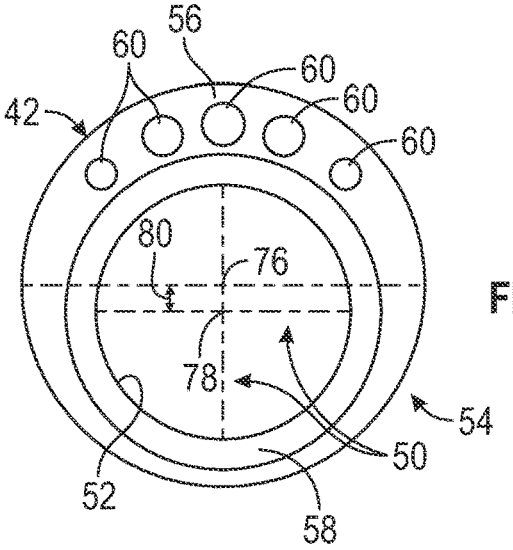
FIG. 6 is an end view of an example of a mandrel which may be used in a swellable packer, according to an embodiment of the disclosure.
Figure 7:
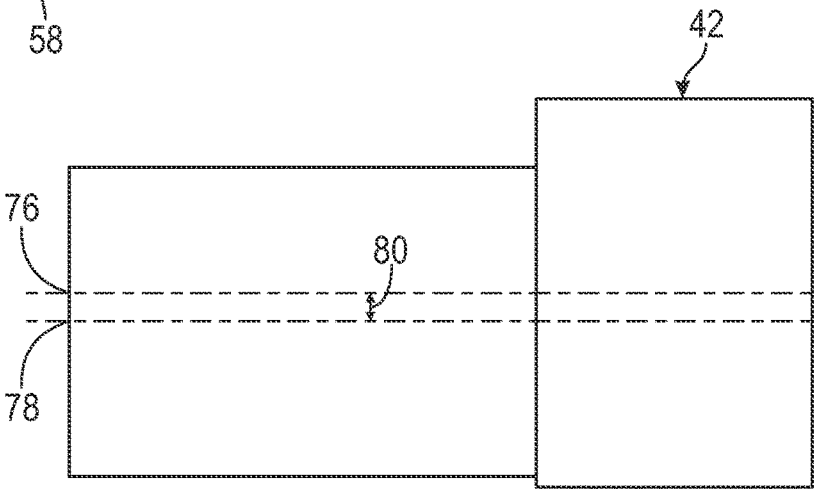
FIG. 7 is a side view of a portion of the mandrel illustrated in FIG. 6, according to an embodiment of the disclosure.

Referring generally to FIGS. 6 and 7, an embodiment of mandrel 42 illustrates the internal geometry 50 as offset with respect to the external geometry 54. In this example, the external geometry 54 of mandrel 42 has a cross-sectional center 76 offset from a cross-sectional center 78 of the internal geometry 50 to achieve a desired eccentricity. The internal geometry 50/longitudinal passage 52 effectively becomes eccentrically located in mandrel 42 with respect to the external geometry 54. A suitable offset distance or length 80 between cross-sectional centers 76 and 78 may be selected to establish desired packer parameters, such as wall thicknesses to accommodate a desired number of bypass conduits 60.

As illustrated in FIG. 6, the eccentric geometries may establish a sufficiently thicker wall portion 56 to accommodate a plurality of the bypass conduits 60. The bypass conduits 60 are sized and arranged according to the desired types of communication lines 46. It should be noted the cross-sectional configuration of the internal geometry 50 and the external geometry 54 may vary in size and shape. In some embodiments, however, the external geometry 54 may be generally circular in cross-section and the internal geometry 50 may similarly be generally circular in cross-section. In such an embodiment, the cross-sectional centers 76, 78 are centers of the respective circulars and offset from each other the desired distance 80.

Depending on the well application, one or more of the swellable packers 38 may be positioned along the well string 32 which may include various forms of downhole completions. The bypass conduits 60 and corresponding communication lines 46 may be used for conducting electrical signals, for transmitting pressure signals, for enabling pumping of sand or gravel slurry, and/or for communicating other types of signals and/or materials past the swellable packer 38.

The communication lines 46 may be routed through a plurality of the swellable packers 38 to traverse, for example, different production zones. Because the bypass conduits 60 are formed through the metal material (or other suitable material) of mandrel 42, the pressure holding capacity of the swellable packer is substantially greater than with traditional swellable packers. The greater volume of material forming the elastomeric element 44 due to undercut 72 also enhances the effectiveness and pressure holding capability of the swellable packer 38. By maintaining the bypass conduit 60 outside of the internal geometry 50/longitudinal passage 52, communication lines 46 may be routed past the swellable packer 38 without affecting through-tubing intervention procedures.

Depending on the environmental parameters and other parameters concerning a given downhole operation, various numbers of swellable packers 38 may be employed along well string 32. Additionally, the size, configuration, and materials forming each elastomeric element 44 may be adjusted to achieve the desired swelling and pressure holding capability in a given environment and with given well fluids. Similarly, the size, configuration, and materials used to construct each mandrel 42 may be selected according to the parameters of a given operation and environment. The techniques for routing communication lines 46 through the corresponding bypass conduits 60 or for coupling communication lines 46 with the bypass conduits 60 may vary from one application and environment to another. Similarly, the types and arrangements of communication lines 46 and corresponding bypass conduits 60 can be adjusted to accommodate a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a swellable packer having a mandrel and an elastomeric element bonded to the mandrel, the elastomeric element undergoing swelling and radial expansion following contact with certain types of fluid in a borehole;

the mandrel having a mandrel wall with an internal geometry in the form of a longitudinal passage of circular cross-section, the mandrel wall being thicker along a portion of a circumference of the mandrel to provide an external geometry having a cross-sectional center offset from an internal geometry cross-sectional center, the mandrel wall having a plurality of bypass conduits extending longitudinally through the portion, the mandrel further comprising an undercut region along an exterior of the mandrel wall to enable increased radial thickness of the elastomeric element, wherein the elastomeric element abuts a transition of the exterior of the mandrel wall to the undercut region.

2. The system as recited in claim 1, wherein the undercut region extends around the entire circumference of the mandrel.

3. The system as recited in claim 1, wherein the swellable packer is mounted along a well string deployed in the borehole.

4. The system as recited in claim 1, further comprising an electrical line extending through at least one bypass conduit of the plurality of bypass conduits.

5. The system as recited in claim 1, further comprising a hydraulic control line extending through at least one bypass conduit of the plurality of bypass conduits.

6. The system as recited in claim 1, further comprising a shunt tube extending through at least one bypass conduit of the plurality of bypass conduits.

7. The system as recited in claim 1, wherein the plurality of bypass conduits comprises two bypass conduits.

8. The system as recited in claim 1, wherein the plurality of bypass conduits comprises three bypass conduits.

9. The system as recited in claim 1, wherein the plurality of bypass conduits comprises four bypass conduits.

10. The system as recited in claim 1, wherein the plurality of bypass conduits comprises at least five bypass conduits.

11. The system as recited in claim 1, wherein the undercut region does not extend around the entire circumference of the mandrel.

12. A system for use in a well, comprising:

a swellable packer having:

an elastomeric element formed of an elastomer which undergoes swelling following contact with certain types of well fluid; and a mandrel extending through the elastomeric element and sealed with respect to the elastomeric element, the mandrel having an interior passage which is offset with respect to an external geometry of the mandrel such that the mandrel has a thicker wall section on one side of the mandrel relative to the other side of the mandrel, the thicker wall section containing a plurality of bypass conduits extending longitudinally through the mandrel, wherein the mandrel comprises an undercut region along an exterior of the mandrel and located between longitudinal ends of the elastomeric element, and wherein the elastomeric element abuts a transition of the exterior of the mandrel to the undercut region.

13. The system as recited in claim 12, wherein the undercut region extends around the entire circumference of the mandrel.

14. The system as recited in claim 12, further comprising an electrical line engaging at least one bypass conduit of the plurality of bypass conduits to enable transmission of electrical signals past the swellable packer.

15. The system as recited in claim 12, further comprising a hydraulic line engaging at least one bypass conduit of the plurality of bypass conduits to enable transmission of hydraulic fluid past the swellable packer.

16. The system as recited in claim 12, further comprising a shunt tube engaging at least one bypass conduit of the plurality of bypass conduits to enable transmission of fluid past the swellable packer.

17. A method, comprising:

forming a mandrel with an internal geometry and an external geometry such that an internal geometry cross-sectional center is offset from an external geometry cross-sectional center;

providing the mandrel with an undercut region disposed along its exterior;

positioning a swellable elastomeric element around the mandrel and along the undercut region, wherein the swellable elastomeric element abuts a transition of the exterior of the mandrel to the undercut region;

sealing the swellable elastomeric element to the mandrel; and routing a bypass conduit longitudinally through the mandrel externally of the internal geometry and radially inside of the swellable elastomeric element.

18. The method as recited in claim 17, wherein routing the bypass conduit comprises routing a plurality of bypass conduits.

19. The method as recited in claim 17, wherein forming comprises forming the internal geometry with a circular cross-section.

20. The method as recited in claim 19, wherein forming the internal geometry with a circular cross-section comprises maintaining a constant diameter of the circular cross-section along a longitudinal length of the mandrel.

* * * * *